United States Patent [19]

Corey

[11] 4,128,104

[45] Dec. 5, 1978

[54] RING STRUCTURE

[75] Inventor: Bernard S. Corey, Corpus Christi, Tex.

[73] Assignees: Foy McCullough; Lyle D. Galbraith, both of Redmond, Wash.

[21] Appl. No.: 861,645

[22] Filed: Dec. 19, 1977

[51] Int. Cl.[2] ..... A45F 1/00

[52] U.S. Cl. ..... 135/3 R; 52/80; 47/17; 135/1 R

[58] Field of Search ..... 52/80, 81, DIG. 10; 135/1 R, 3 R; 220/19; 47/17; 52/63

[56] References Cited

U.S. PATENT DOCUMENTS

| | | | |
|---|---|---|---|
| 353,131 | 11/1886 | Greenwood | 220/19 |
| 820,716 | 5/1906 | Haynes | 220/19 |
| 2,548,966 | 4/1951 | Gilmore | 220/19 |
| 2,956,806 | 10/1960 | Roatson | 52/DIG. 10 |
| 3,051,185 | 8/1962 | Reynolds | 135/3 R |
| 3,405,886 | 10/1968 | Gosnell | 135/1 R |
| 3,674,276 | 7/1972 | Street | 52/DIG. 10 |

FOREIGN PATENT DOCUMENTS

| | | | |
|---|---|---|---|
| 681598 | 3/1964 | Canada | 135/3 |

OTHER PUBLICATIONS

Domebook II © 4/2/71, pp. 95 and 118.

*Primary Examiner*—Price C. Faw, Jr.
*Assistant Examiner*—Henry Raduazo
*Attorney, Agent, or Firm*—Dowrey & Cross

[57] ABSTRACT

A structural framework composed of at least five intersected ring members providing a dome-shaped configuration over which a covering may be applied. A particular manner of ring member intersection is employed to make the structure self-supporting and to enable the ring members to be positioned with respect to one another to provide other geometric configurations.

3 Claims, 8 Drawing Figures

FIG. 1
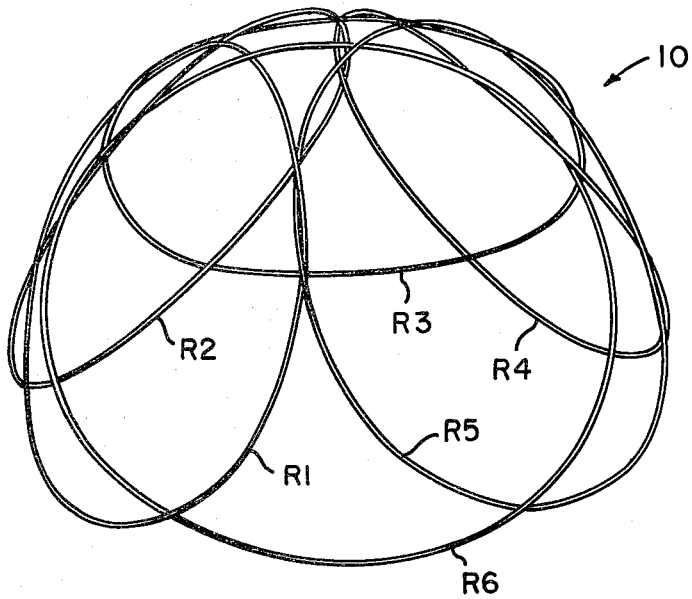
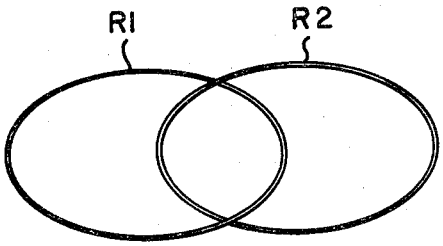
FIG. 2
FIG. 3
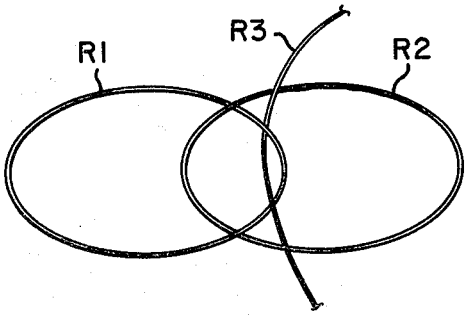
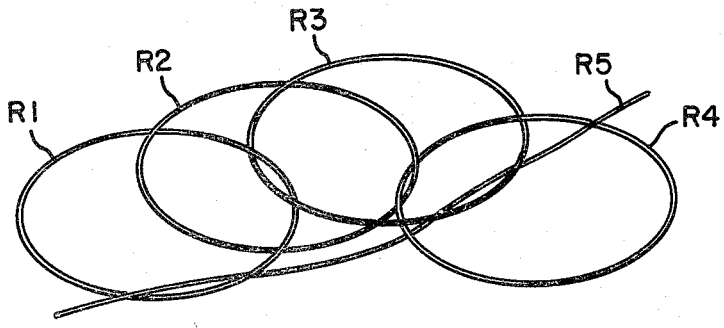
FIG. 4

FIG. 5
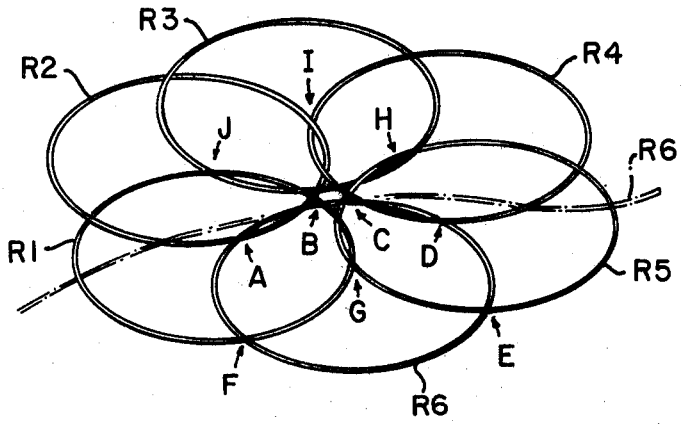
FIG. 6
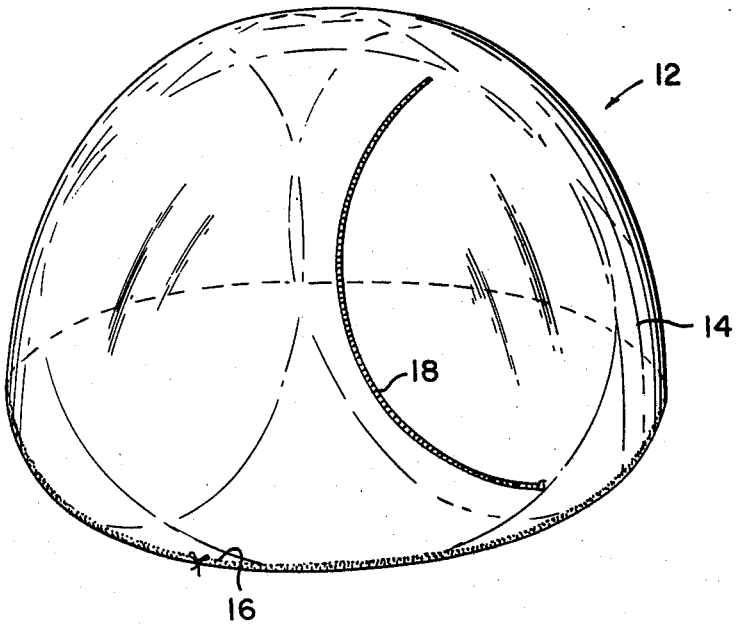
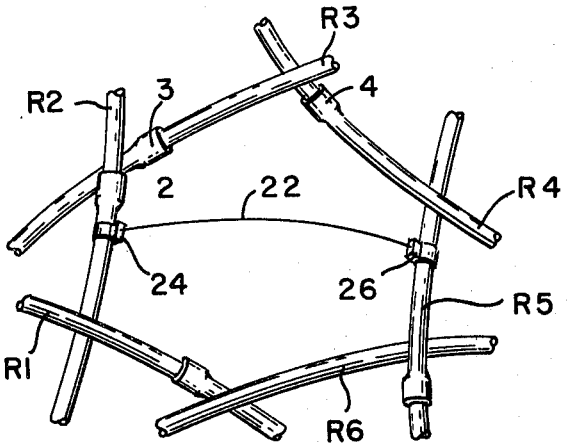
FIG. 7
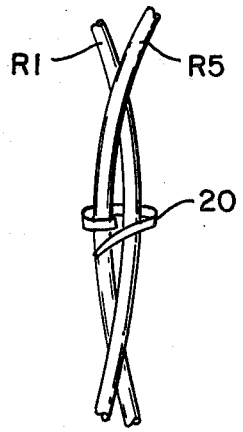
FIG. 8

RING STRUCTURE

This invention is a structural framework composed of ring members intersecting one another in a particular manner. The framework may be assembled as a coplanar unit and then raised from the center to provide a self-supporting dome over which a covering may be applied. Each ring member must intersect at least four other ring members and consequently the framework must be constructed of at least five ring members.

FIG. 1 depicts an exemplary structural framework, having particular utility as a dome-like frame for a small structure, composed of six ring members;

FIG. 2–5 depict an in sequence method of assembling six ring members for the framework of FIG. 1;

FIG. 6 depicts the FIG. 1 framework with a flexible covering for use as a greenhouse; FIG. 7 depicts the top of the FIG. 1 framework fitted with a doming member to prevent formation of a depression in the flexible covering at the top of the FIG. 6 structure; and FIG. 8 depicts a pair of intersecting ring members secured together by a strap to enhance the stability of the FIG. 1 framework.

The essential manner of ring member intersection can be seen with reference to FIG. 5. Viewing ring member R6, that ring extends, starting at point A and going clockwise in sequence, over and under ring member R2, then over ring member R1, under ring member R5, over and under ring member R4, over ring member R5, and under ring member R1. Each of the other ring members intersects its adjacent ring members similarly. Thus, each ring member intersects four other ring members twice, once extending over and once extending under each of the four other ring members. Furthermore, it will be observed that each ring member extends over and under one adjacent ring member (e.g. ring member R6 extends over and under ring member R2 at point A) without intermediately intersecting another ring member, than extends over another ring member and then under still another ring member (e.g. ring member R6 extends over ring member R1 at point B and then under ring member R5 at point C), then extends over and under still a fourth adjacent ring member (e.g. ring member R6 extends over and under ring member R4 at point D) without intermediately intersecting another ring member, extends under a ring member that it previously had extended over (e.g. ring member R6 extends over ring member R5 at point E and had previously extended under it at point C), and finally under a ring member that it previously had extended over (e.g. ring member R6 extends under ring member R1 at point F and had previously extended over it at point B).

The words "over" and "under" as used herein are to be interpreted to include their opposites inasmuch as the ring members could be intersected either way. For example, ring member R6 in FIg. 5 could extend at point A under and then over ring member R2, then under ring member R1 and over ring member R5, under and over ring member R4, under ring member R5 and over ring member R1, and thus yield essentially the identical structure. The words "over" and "under" as used herein are not to be interpreted to exclude the reversal exemplified above.

Upon the assembly of the structure in coplanar form as shown in FIG. 5, the structure may be raised from the center to provide the dome depicted in FIG. 1. The dome is self-supporting and quite stable. The preferred structure is composed of ring members whose cross-sectional diameters are not greater than about 1/120th of their ring circumferences to enable the ring members to interlock without being stressed beyond their elastic limit. Additional stability may be attained simply by tying adjacent ring members together at the points of intersection where at ring members extend over and under one another such as at point G of FIG. 5 and as illustrated by tie 20 in FIG. 8 with respect to ring members R1 and R5.

The framework of FIG. 1 forms a generally hexagonal configuration. Looking at FIG. 5, the faces of the hexagon are located by points A,G; G,D; D,H; H,I; I,J; and J,A. Within the hexagon are two triangular configurations. Looking at FIG. 5, the triangular faces of one configuration are located by points A,D; D,I; and I,A. The triangular faces of the other configuration are located by points G,H; H,J; and J,G. Similarly, if five ring members were used, the geometric configuration would be pentagonal and triangular; if eight ring members were used, the geometric configuration would be octagonal and triangular; and so forth.

Once the framework of FIG. 1 has been formed, the ring members at the apex of the dome could be separated from one another by shifting them radially outward from one another to form a more spherical structure. This is so inasmuch as this radial movement at the apex causes the ring members at the lower periphery to shift radially inward toward one another. In fact, the radial shifting could be continued until the structure becomes an inverted dome with its apex at the bottom.

Although one preferred embodiment of the invention has been illustrated and described herein, variations will become apparent to one of ordinary skill in the art. Accordngly, the invention is not to be limited to the specific embodiment illustrated and described herein and the true scope and spirit of the invention are to be determined by reference to the appended claims.

I claim:

1. A structure composed of a plurality of ring members at least five in number, each ring member extending over and under at least four other ring members in a manner such that each ring extends, in sequence, over and under a first ring member, over a second ring member, under a third ring member, over and under a fourth ring member, over the third ring member, and under the second ring member.

2. The structure of claim 1 wherein said ring members are positioned with respect to one another such that the structure is dome-shaped with a raised apex.

3. The structure of claim 2 wherein six ring members are provided to provide a hexagonal configuration.

* * * * *